US005954110A

United States Patent [19]

Ingram

[11] Patent Number: 5,954,110

[45] Date of Patent: Sep. 21, 1999

[54] EXTENDIBLE BLIND ASSEMBLY

[76] Inventor: Charles J. Ingram, 10066 Pandora Dr., La Mesa, Calif. 91941

[21] Appl. No.: 09/015,097

[22] Filed: Jan. 29, 1998

[51] Int. Cl.[6] ..... E06B 9/26

[52] U.S. Cl. ..... 160/176.1 V; 160/167 V; 160/174 V; 160/177 V; 160/178.1 V; 16/94 R

[58] Field of Search ..... 160/107, 89, 127, 160/115, 236, 167 V, 174 V, 176.1 V, 177 V, 178.1 V, 900; 16/87.4 R, 94 R

[56] References Cited

U.S. PATENT DOCUMENTS

| | | | |
|---|---|---|---|
| D. 275,828 | 10/1984 | Brolin | D6/580 |
| 2,211,482 | 8/1940 | Turner | 16/87.4 R |
| 3,296,744 | 1/1967 | Hentzi | 16/94 R |
| 3,795,940 | 3/1974 | DiMascio | 160/87.4 R X |
| 4,407,350 | 10/1983 | Nakamura | 160/178.1 V |
| 4,657,061 | 4/1987 | Meier | 160/176.1 V |
| 5,062,464 | 11/1991 | Peterson | 160/193 |
| 5,139,071 | 8/1992 | Danchulis | 160/176.1 V |
| 5,209,282 | 5/1993 | Franco et al. | 160/236 |
| 5,222,540 | 6/1993 | Varga | 160/222 |
| 5,309,974 | 5/1994 | Fraser | 160/176.1 |
| 5,392,832 | 2/1995 | Colson et al. | 160/176.1 V |
| 5,392,833 | 2/1995 | Ohanesian | 160/89 |
| 5,439,042 | 8/1995 | Ohanesian | 160/89 |
| 5,657,807 | 8/1997 | Hsu | 160/178.1 V |

*Primary Examiner*—Daniel P. Stodola
*Assistant Examiner*—Bruce A Lev

[57] ABSTRACT

An extendible drapery assembly including a mounting track. A plurality of roller assemblies are slidably coupled along the mounting track. Next provided is a blind control assembly coupled to each of the roller assemblies. Also included is a plurality of discrete blinds each connected to one of the associated blind control assemblies. Each blind includes at least two blind portions hingably coupled along side edges thereof. In use, the blind portions are rotatable between an extended orientation with the blind portions linearly aligned in tandem and a retracted orientation with faces of the blind portions abutting each other. Finally, a control mechanism is provided for allowing the selective transfer of the blind portions between the extended and retracted orientation.

9 Claims, 5 Drawing Sheets

EXTENDIBLE BLIND ASSEMBLY

BACKGROUND OF THE INVENTION

1. Field of the Invention

The present invention relates to vertical blinds and more particularly pertains to a new extendible blind assembly for selectively simulating drapes with vertical blinds thus blocking sunlight through a transparent door or window more effectively.

2. Description of the Prior Art

The use of vertical blinds vertical blinds is known in the prior art. More specifically, vertical blinds heretofore devised and utilized are known to consist basically of familiar, expected and obvious structural configurations, notwithstanding the myriad of designs encompassed by the crowded prior art which have been developed for the fulfillment of countless objectives and requirements.

Known prior art vertical blinds include U.S. Pat. No. 5,439,042; U.S. Pat. No. 5,309,974; U.S. Pat. No. 5,209,282; U.S. Pat. No. 5,392,833; U.S. Pat. No. 5,222,540; and U.S. Pat. No. 275,828.

In these respects, the extendible blind assembly according to the present invention substantially departs from the conventional concepts and designs of the prior art, and in so doing provides an apparatus primarily developed for the purpose of selectively simulating drapes with vertical blinds thus blocking sunlight through a transparent door or window more effectively.

SUMMARY OF THE INVENTION

In view of the foregoing disadvantages inherent in the known types of vertical blinds now present in the prior art, the present invention provides a new extendible blind assembly construction wherein the same can be utilized for selectively simulating drapes with vertical blinds thus blocking sunlight through a transparent door or window more effectively.

The general purpose of the present invention, which will be described subsequently in greater detail, is to provide a new extendible blind assembly apparatus and method which has many of the advantages of the vertical blinds mentioned heretofore and many novel features that result in a new extendible blind assembly which is not anticipated, rendered obvious, suggested, or even implied by any of the prior art vertical blinds, either alone or in any combination thereof.

To attain this, the present invention generally comprises an elongated hollow mounting track having a square cross-section. As shown in FIG. 11, a slot is formed length wise along a bottom face of the mounting track. During use, the mounting track is situated along an upper edge of a window. Note FIGS. 1 & 5. Next provided is a plurality of roller assemblies each including an L-shaped member. As shown in FIG. 11, each roller assembly is equipped with an upper vertical extent situated within the mounting track. A roller is rotatably coupled to the upper vertical extent in rolling abutment within the mounting track. Associated therewith is a lower horizontal extent integrally coupled to the vertical extent and situated below the mounting track. With reference now to FIGS. 6, 8 & 9, it is shown that a plurality of upper blind control assemblies are provided. Each upper blind control assembly includes a central linear member rotatably coupled at a central extent thereof to the horizontal extent of an associated one of the roller assemblies. A pair of end linear members each have a pulley fixedly coupled to an end thereof. Such pulleys are, in turn, rotatably coupled to a corresponding end of the central linear member. A belt connects the pulleys thus effecting the coincident rotation thereof. By this structure, the end linear members are rotatable within a horizontal plane including the central member. Such rotation is permitted between an extended orientation with the central linear member and end linear members linearly aligned in tandem and a retracted orientation with ends of the end linear members abutting each other. As shown in FIGS. 1, 3, 4, & 7, a plurality of blinds are provided each having a central extent with an elongated rectangular configuration and a pair of end extents each also with an elongated rectangular configuration. The end extents are hingably coupled to side edges of the central extent. The central extent has a top edge fixedly coupled along the central member of an associated one of the upper blind control assemblies. Similarly, the end extents each have a top edge fixedly coupled to corresponding end extents of the upper blind control assemblies. As such, the central and end extents reside in a plane including the central and end linear members of the corresponding blind control assembly, respectively. As shown in FIG. 3, the central extent and end extents of each blind are each covered with a single unitary cloth sleeve. With reference now to FIG. 9, a first control mechanism is provided including a pair of flexible inelastic straps fixedly coupled in parallel to opposite ends of the central linear members of each blind control assembly. Such straps are adapted for effecting the pivoting of the blinds about a central vertical axis between a closed coplanar orientation and an open orientation wherein the central extents of the blinds reside in separate parallel planes. A second control mechanism serves to permit the sliding of the blind control assemblies between a gathered orientation and a spaced extended orientation. Finally, a third control mechanism is provided including a single flexible inelastic strap coupled to each end extent control. In operation, the single strap of the third control mechanism is adapted for allowing the manual shifting of the end extents of each blind between the extended and retracted orientation thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new extendible blind assembly apparatus and method which has many of the advantages of the vertical blinds mentioned heretofore and many novel features that result in a new extendible blind assembly which is not anticipated, rendered obvious, suggested, or even implied by any of the prior art vertical blinds, either alone or in any combination thereof.

It is another object of the present invention to provide a new extendible blind assembly which may be easily and efficiently manufactured and marketed.

It is a further object of the present invention to provide a new extendible blind assembly which is of a durable and reliable construction.

An even further object of the present invention is to provide a new extendible blind assembly which is susceptible of a low cost of manufacture with regard to both materials and labor, and which accordingly is then susceptible of low prices of sale to the consuming public, thereby making such extendible blind assembly economically available to the buying public.

Still yet another object of the present invention is to provide a new extendible blind assembly which provides in the apparatuses and methods of the prior art some of the advantages thereof, while simultaneously overcoming some of the disadvantages normally associated therewith.

Still another object of the present invention is to provide a new extendible blind assembly for selectively simulating drapes with vertical blinds thus blocking sunlight and visibility through a transparent door or window more effectively.

Even still another object of the present invention is to provide a new extendible blind assembly that includes a mounting track. A plurality of roller assemblies are slidably coupled along the mounting track. Next provided is a blind control assembly coupled to each of the roller assemblies. Also included is a plurality of discrete blinds each connected to one of the associated blind control assemblies. Each blind includes at least two blind portions hingably coupled along side edges thereof. In use, the blind portions are rotatable between an extended orientation with the blind portions linearly aligned in tandem and a retracted orientation with faces of the blind portions abutting each other. Finally, a control mechanism is provided for allowing the selective transfer of the blind portions between the extended and retracted orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
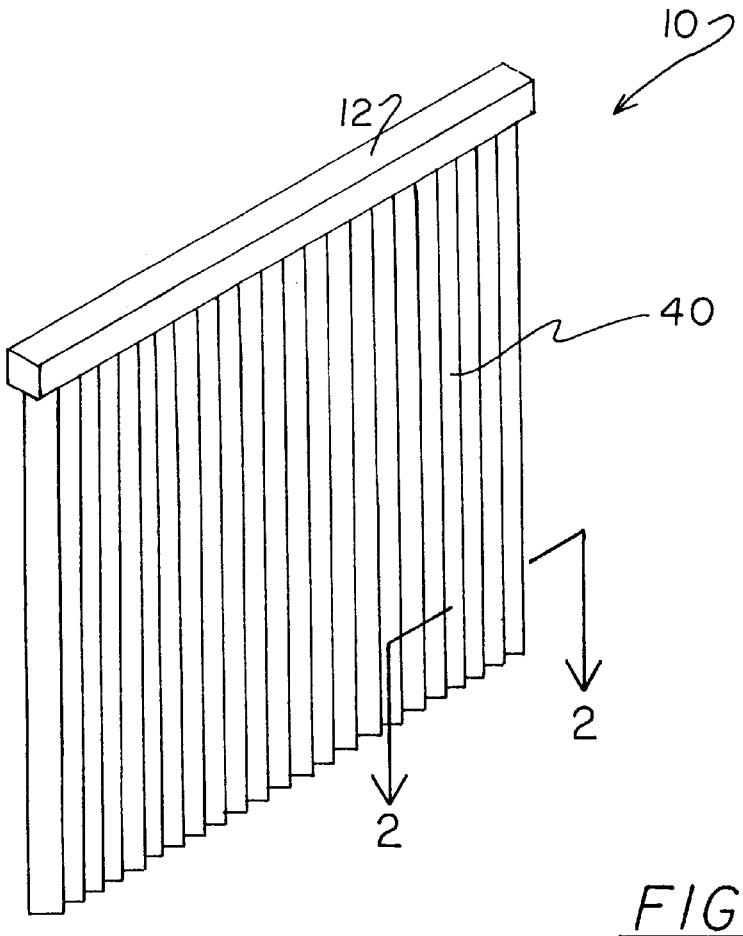
FIG. 1 is a perspective view of a new extendible blind assembly according to the present invention.
Figure 2:
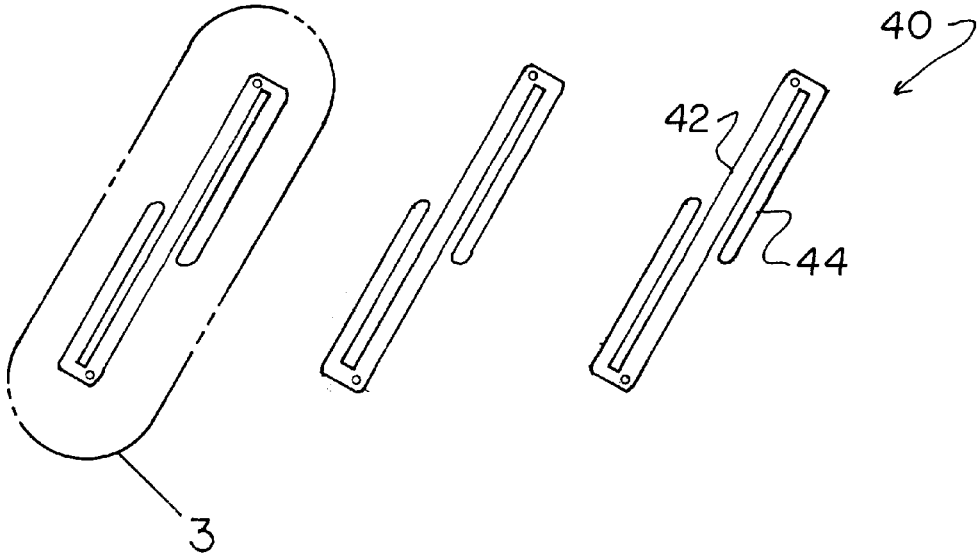
FIG. 2 is a cross-sectional view of the present invention taken along line 2—2 shown in FIG. 1.

With reference now to the drawings, and in particular to FIGS. 1 through 12 thereof, a new extendible blind assembly embodying the principles and concepts of the present invention and generally designated by the reference numeral 10 will be described.

Figure 5:
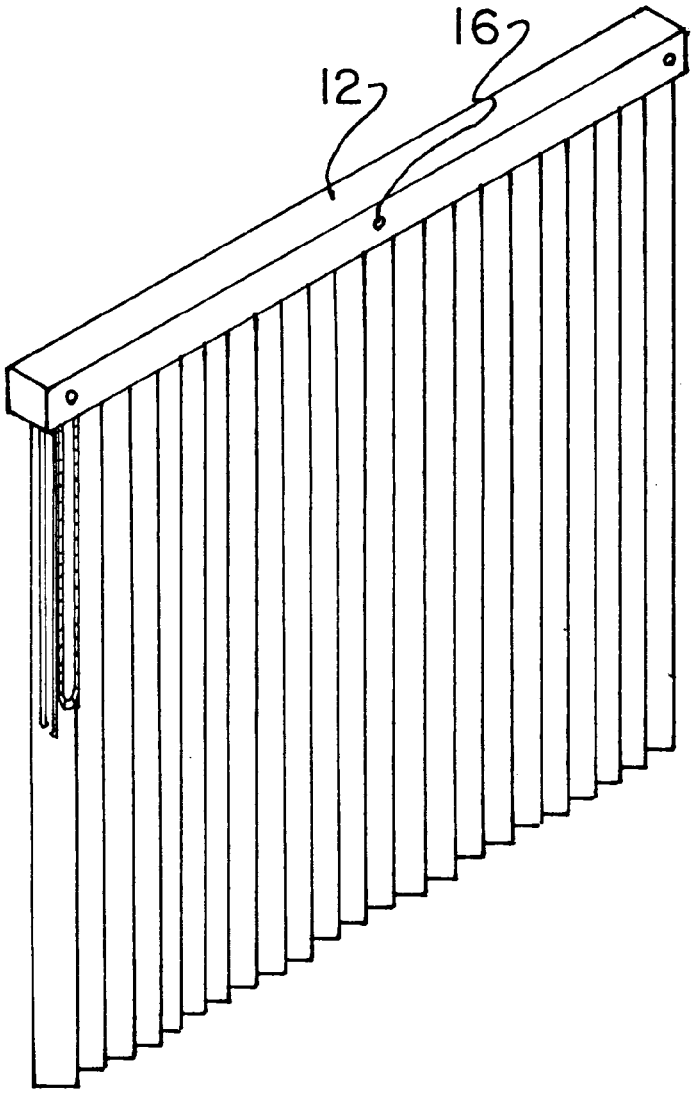
FIG. 5 is a rear perspective view of the present invention.
Figure 11:
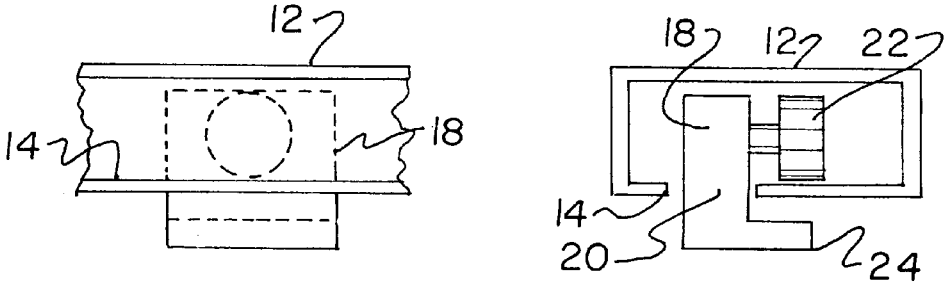
FIG. 11 is a side and end view of the mounting track and one of the roller assemblies of the present invention.

The present invention as designated as numeral 10 includes an elongated hollow mounting track 12 having a square cross-section. As shown in FIG. 11, a slot 14 is formed length wise along a bottom face of the mounting track. During use, the mounting track is situated along an upper edge of a window. Note FIGS. 1 & 5. As shown in FIG. 5, a rear face of the mounting track is equipped with bores 16 for allowing the mounting track to be mounted to a recipient surface, namely a wall.

Next provided is a plurality of roller assemblies 18 each including an L-shaped member. As shown in FIG. 11, each roller assembly is equipped with an upper vertical extent 20 situated within the mounting track. A roller 22 is rotatably coupled to the upper vertical extent in rolling abutment within the mounting track. Associated therewith is a lower horizontal extent 24 integrally coupled to the upper vertical extent and situated below the mounting track.

Figure 6:
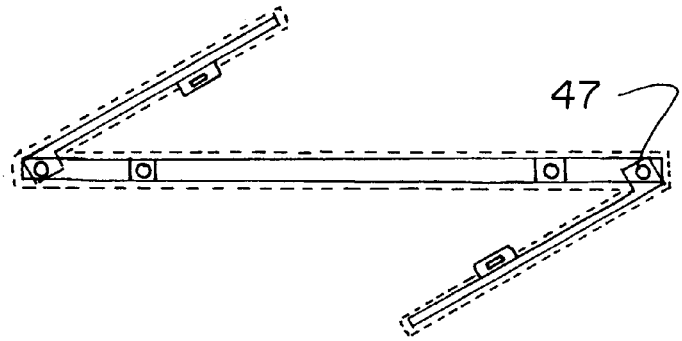
FIG. 6 is a top view of one of the bottom blind assemblies.
Figure 7:
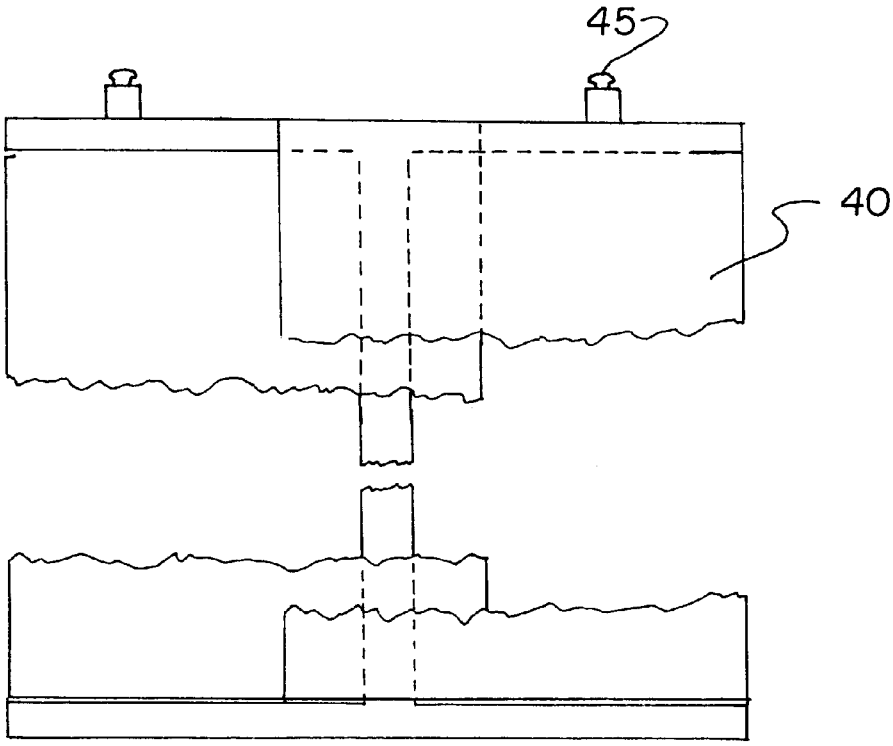
FIG. 7 is a vertical view of the construction of the blinds as shown in FIG. 6.
Figure 8:
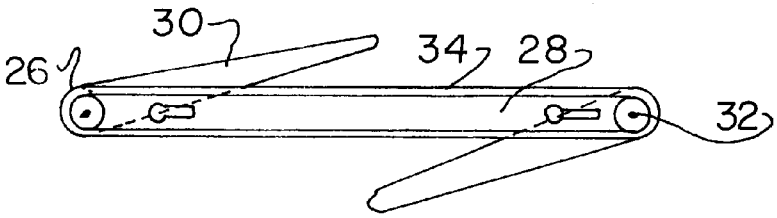
FIG. 8 is a top view of one of the upper blind control assemblies of the present invention.
Figure 9:
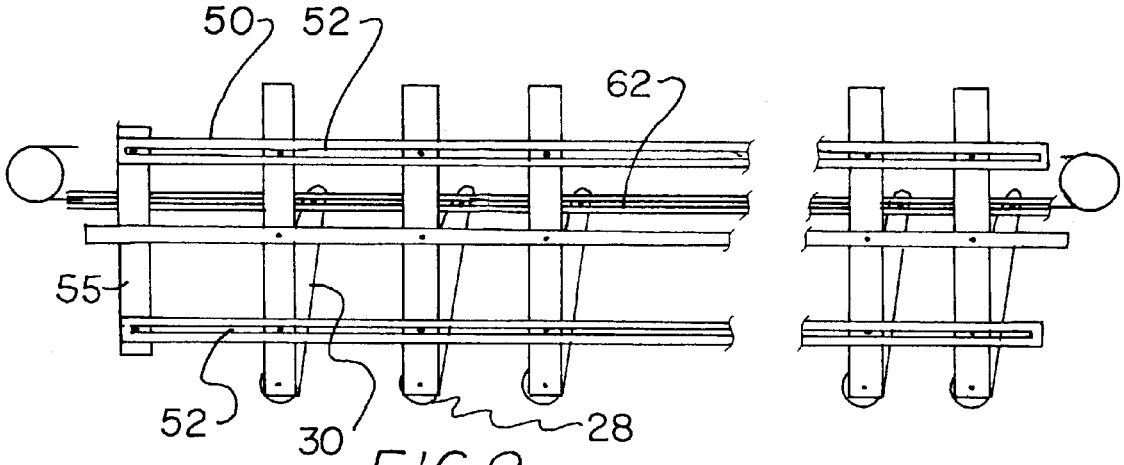
FIG. 9 is a top view of the upper blind control assemblies as shown in FIG. 8 in addition to the control mechanism and mounting track.
Figure 10:
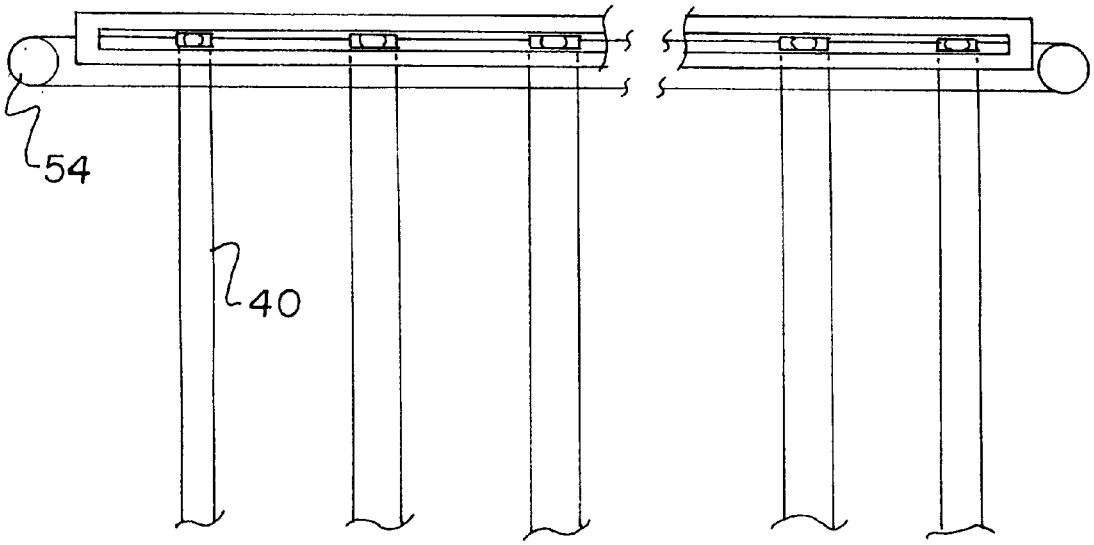
FIG. 10 is a side view of the components shown in FIG. 9. This view also describes the control to extend or retract the panel assemblies. The control is connected to point 54.

With reference now to FIGS. 6, 8 & 9, it is shown that a plurality of upper blind control assemblies 26 are provided. Each upper blind control assembly includes a central linear member 28 rotatably coupled at a central extent thereof to the horizontal extent of an associated one of the roller assemblies. A pair of end linear members 30 each have a pulley 32 fixedly coupled to an end thereof. Such pulleys are, in turn, rotatably coupled to a corresponding end of the central linear member. A belt 34 connects the pulleys thus effecting the coincident rotation thereof.

By this structure, the end linear members are rotatable within a horizontal plane about the central linear member. Such rotation is permitted between an extended orientation with the central linear member and end linear members linearly aligned in tandem and a retracted orientation with ends of the end linear members nearly abutting each other. Note FIG. 8.

As shown in FIGS. 1, 3, 4, & 7, a plurality of rigid blinds 40 are provided each having a central extent 42 with an elongated rectangular configuration and a pair of end extents 44 each also with an elongated rectangular configuration. The end extents are pinned 47 (FIG. 6) to the central extent top and bottom. The central extent has a top edge fixedly coupled along the central linear member of an associated one of the upper blind control assemblies via a pair of tabs 45 which are frictionally inserted within apertures formed in the central linear member of the upper blind control assembly. Similarly, the end extents each have a top edge fixedly coupled to corresponding end linear members of the upper blind control assemblies.

As such, the central and end extents of each blind reside in a plane including the central and end linear members of the corresponding blind control assembly, respectively. To permit the end extents of the blinds to fold against the central extent thereof when the end members of the associated upper blind control assembly are in a retracted orientation, the end extents preferably have an L-shaped cross-section. While such design permits the end extends to reside in parallel in a retracted orientation, the end extents afford a bellowed surface when fully extended. It should be noted that structures constructed in a manner similar to the upper blind control assemblies are included at the bottom of each of the blinds and constitute lower blind control assemblies. Note FIG. 7.

Figure 3:
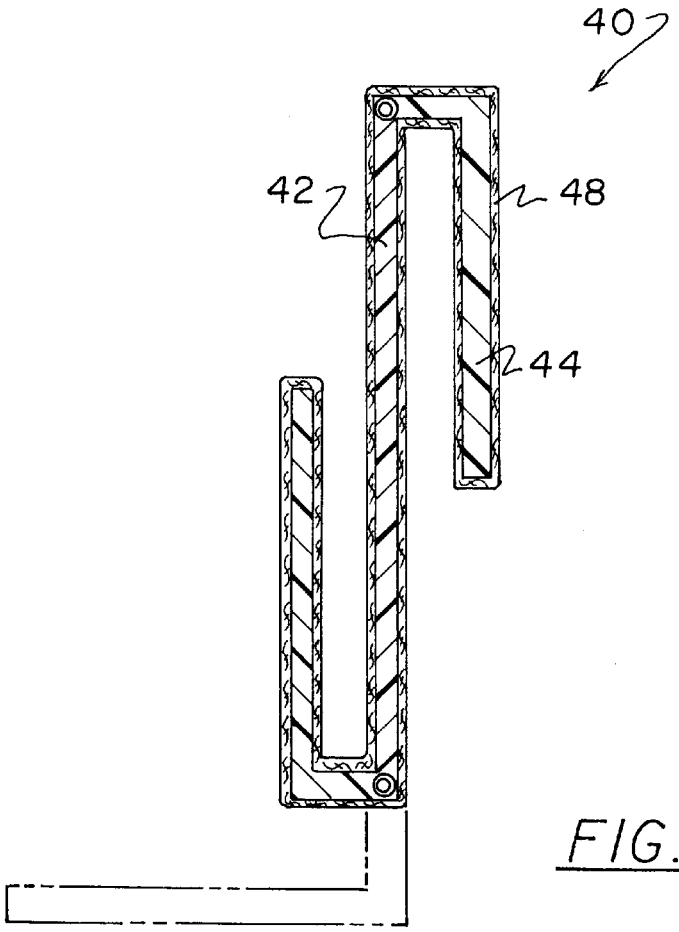
FIG. 3 is a cross-sectional view of one of the blinds of the present invention encircled in FIG. 2.
Figure 4:
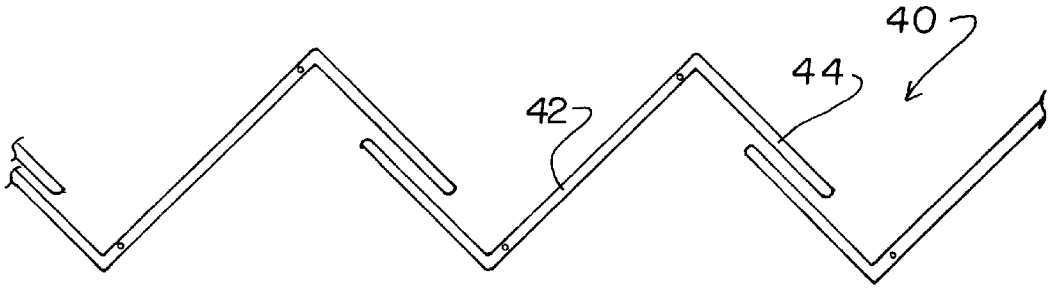
FIG. 4 is a top view of the blinds of the present invention between the retracted and extended orientation thereof.

As shown in FIG. 3, the central extent and end extents of each blind are each covered with a single unitary cloth sleeve 48. Such sleeve is easily removed for cleaning purpose. Further, the sleeve functions to conceal the hingable coupling between the central and end extents of the blinds.

With reference now to FIG. 9, a first control mechanism 50 is provided including a pair flexible inelastic straps 52 fixedly coupled in parallel to opposite ends of the central linear members of each blind control assembly. Such straps are adapted for effecting the pivoting of the blinds about a central vertical axis between a closed coplanar orientation and an open orientation wherein the central extents of the blinds reside in separate parallel planes. Rotation control of the panel assemblies is provided by a vertical control rod connected to horizontal control 55, as shown in FIG. 9.

A second control mechanism is provided including a single flexible inelastic strap 62 coupled to the end linear member 30 (FIG. 8) of each of the blind control assemblies. In operation, the single strap of the second control mechanism is adapted for allowing the manual shifting of the end extents of each blind between the extended and retracted orientation thereof. Rotation may be accomplished by pulleys attached to each end of strap 62. Note FIG. 9. A third control is provided by pulleys 54. This allows the extending or retracting of the panel assemblies. Note FIG. 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An extendible drapery system comprising, in combination:

an elongated hollow mounting track having a square cross-section with a slot formed length wise along a bottom face thereof, the mounting track adapted to be situated along an upper edge of a window;

a plurality of roller assemblies each including an L-shaped member with an upper vertical extent situated within the mounting track with a roller rotatably coupled thereto in rolling abutment within the mounting track and a lower horizontal extent integrally coupled to the vertical extent and situated below the mounting track;

a plurality of upper blind control assemblies each including a central linear member rotatably coupled at a central extent thereof to the horizontal extent of an associated one of the roller assemblies, a pair of end linear members each having a pulley fixedly coupled to an end thereof and rotatably coupled to a corresponding end of the central member with a belt connecting the pulleys thus effecting the coincident rotation thereof, whereby the end linear members are rotatable within a horizontal plane about the central member between an extended orientation with the central linear member and end linear members linearly aligned in tandem and a retracted orientation with ends of the end linear members abutting each other;

a plurality of blinds each having a central extent with an elongated rectangular configuration and a pair of end extents each also with an elongated rectangular configuration and hingably coupled to side edges of the central extent, the central extent having a top edge fixedly coupled along the central member of an associated one of the upper blind control assemblies and the end extents each having a top edge fixedly coupled to corresponding end extents of the upper blind control assemblies such that the central and end extents reside in a plane including the central and end linear members of the corresponding blind control assembly, respectively, wherein the central extent and end extents of each blind are each covered with a single unitary cloth sleeve;

a first control mechanism including a pair flexible inelastic straps fixedly coupled in parallel to opposite ends of the central linear members of each blind control assembly for effecting the pivoting of the blinds about a central vertical axis wherein the central extents of the blinds reside in separate parallel planes;

a second control mechanism including a single flexible inelastic strap coupled to a control end of each of the end linear members of the blind control assemblies for allowing the manual shifting of the end extents of each blind between the extended and retracted orientation thereof; and a third control mechanism adapted to permit the sliding of the blind control assemblies between a gathered orientation and a spaced extended orientation.

2. An extendible drapery system comprising, in combination:

a mounting track;

a plurality of roller assemblies slidably coupled along the mounting track;

a blind control assembly coupled to each of the roller assemblies;

a plurality of discrete blinds each connected to associated one of the blind control assemblies including at least two blind portions hingably coupled along side edges thereof, whereby the blind portions are rotatable between an extended orientation with the blind portions linearly aligned in tandem and a retracted orientation with faces of the blind portions abutting each other; and a control mechanism for allowing the selective transfer of the blind portions between the extended orientation and the retracted orientation;

wherein each blind includes a central extent and a pair of end extents hingably coupled to opposite side edges of the central extent;

wherein the blind control assemblies each include a central member coupled to one of the roller assemblies, a pair of end members coupled to a corresponding end of the central member with pulley means coupled therebetween, the central and end members coupled to the central and end extents of the blinds, respectively, whereby the end linear members are rotatable within a horizontal plane about the central member between an extended orientation with the central linear member and end linear members linearly aligned in tandem and a retracted orientation.

3. An extendible drapery system as set forth in claim 2 wherein the central extent and end extents of each blind are covered with a single unitary cloth sleeve.

4. An extendible drapery system as set forth in claim 2 wherein the blind control assemblies are rotatably coupled to each of the roller assemblies and further included is a second control mechanism for effecting the pivoting of the central extent of each blind about a central vertical axis between a closed coplanar orientation and an open orientation wherein the central extent of the blinds reside in separate parallel planes.

5. An extendible drapery system as set forth in claim 4 wherein a third control mechanism is adapted to permit the sliding of the central extents of the blinds between a gathered orientation and a spaced extended orientation.

6. An extendible drapery assembly comprising, in combination:

a mounting track;

a plurality of roller assemblies slidably coupled along the mounting track;

a blind control assembly coupled to each of the roller assemblies;

a plurality of discrete blinds each connected to associated one of the blind control assemblies including at least two blind portions hingably coupled along side edges thereof, whereby the blind portions are rotatable between an extended orientation with the blind portions linearly aligned in tandem and a retracted orientation with faces of the blind portions abutting each other; and a control mechanism for allowing the selective transfer of the blind portions between the extended and retracted orientations;

wherein each blind includes a central extent and a pair of end extents hingably coupled to opposite side edges of the central extent;

wherein the blind control assemblies are rotatably coupled to each of the roller assemblies and further included is a second control mechanism for effecting the pivoting of the central extent of each blind about a central vertical axis between a closed coplanar orientation and an open orientation wherein the central extent of the blinds reside in separate parallel planes.

7. An extendible drapery assembly as set forth in claim 6 wherein the blind control assemblies each includes a central member coupled to one of the roller assemblies, a pair of end members coupled to a corresponding end of the central member with pulley means coupled therebetween, the central and end members coupled to the central and end extents of the blinds, respectively, whereby the end linear members are rotatable within a horizontal plane about the central member between an extended orientation with the central linear member and end linear members linearly aligned in tandem and a retracted orientation.

8. An extendible drapery assembly as set forth in claim 6 wherein the central extent and end extents of each blind are covered with a single unitary cloth sleeve.

9. An extendible drapery assembly as set forth in claim 6 wherein a third control mechanism is adapted to permit the sliding of the central extents of the blinds between a gathered orientation and a spaced extended orientation.

* * * * *